US006892047B1

(12) United States Patent
Giannetti et al.

(10) Patent No.: US 6,892,047 B1
(45) Date of Patent: May 10, 2005

(54) AIR BAFFLE FOR PAPER TRAVEL PATH WITHIN AN ELECTROPHOTOGRAPHIC MACHINE

(75) Inventors: John Giannetti, Penfield, NY (US); Giovanni B. Caiazza, Rochester, NY (US); Jerome F. Sleve, Henrietta, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/668,416

(22) Filed: Sep. 23, 2003

Related U.S. Application Data

(60) Provisional application No. 60/413,396, filed on Sep. 25, 2002.

(51) Int. Cl.[7] ..... G03G 15/00
(52) U.S. Cl. ..... 399/400; 399/324
(58) Field of Search ..... 399/297, 308, 399/320, 322, 324, 397, 400; 101/232; 400/625, 400/642

(56) References Cited

U.S. PATENT DOCUMENTS

| | | | | |
|---|---|---|---|---|
| 3,140,160 | A * | 7/1964 | Carlson | 34/630 |
| 3,502,407 | A * | 3/1970 | Ellis et al. | 399/335 |
| 5,223,903 | A * | 6/1993 | Russel et al. | 399/400 |
| 5,497,987 | A * | 3/1996 | Henn et al. | 271/204 |
| 6,678,496 | B1 * | 1/2004 | Aslam et al. | 399/323 |
| 2003/0190175 | A1 * | 10/2003 | Pitts et al. | 399/322 |
| 2004/0218953 | A1 * | 11/2004 | Gross et al. | 399/400 |

* cited by examiner

*Primary Examiner*—Ren Yan
(74) *Attorney, Agent, or Firm*—Kevin L. Leffel; Richard A. Romanchik

(57) ABSTRACT

A means and a method for increasing the efficiency of a vacuum-assisted, fuser entrance guide in an electrophotographic apparatus by blocking and deflecting air currents away the sheet of copy medium as the sheet moves from a vacuum transport towards the entrance guide. A baffle is positioned in the gap between the vacuum transport and the fuser entrance guide that form the travel path for the sheet through the apparatus. The baffle has a deflecting surface that extends substantially across the gap, which diverts the air currents away from the sheet.

16 Claims, 3 Drawing Sheets

AIR BAFFLE FOR PAPER TRAVEL PATH WITHIN AN ELECTROPHOTOGRAPHIC MACHINE

This application claims the benefit of Provisional Application No. 60/413,396, filed Sep. 25, 2002.

FIELD OF THE INVENTION

The present invention relates to the paper travel path within an electrophotographic copier/printer apparatus and in one of its aspects relates to an air baffle for diverting air away from a sheet of paper as the paper moves along a travel path between an image transfer loop (film) and the entrance of the fuser section of an electrophotographic apparatus.

BACKGROUND OF THE INVENTION

In a typical electrophotographic machine (e.g. copier, duplicator, printer, etc.), a continuous loop of a photoconductor film is commonly used to transfer an image from an input section onto a copy medium (e.g. a sheet of paper or the like). The film is initially charged and passed through an input section where an image is projected onto the charged film. The film then moves through a developing section where toner is applied to the charged image, and on through an image transfer section where the toner is transferred to a sheet of paper or some other medium. The toner (i.e. image) is then fixed (i.e. fused) to the sheet by passing the sheet between a pressure roller and a heated roller within the fuser section of the machine.

In electrophotographic machines of this type, it is common to use a vacuum transport to transfer the sheet from the film loop to the fuser section. Often this vacuum transport is directly interfaced between the film and the fuser section wherein the vacuum transport receives the sheet from the film and passes it directly into nip between the rollers in the fuser section. This requires that the surface speeds of (a) the film loop, (b) the vacuum transport belt(s), and (c) the fuser rollers all have to be closely matched. If the speeds become mismatched, there may be relative movement between the film and the sheet while the image is being transferred onto the sheet thereby resulting in smearing of the image on the sheet.

To alleviate this problem, some commercial machines have now abandoned any direct interface between the film and the fuser section and instead, use a curved or arched travel path between the image transfer and the fuser sections which is longer than the straight-line distance between these sections (i.e. longer than the length of any sheet to be used in the copy operations). This extended path effectively "de-couples" the speed of the fuser rollers from the speed of the film thereby eliminating the possibility of relative movement between the sheet and the film as the toner image is being transferred.

Such an extended, curved travel path is typically provided by angling the vacuum transport away from the straight-ine distance between the sections and then positioning a fuser entrance guide between the exit end of the vacuum transport and the entrance of the fuser section. The fuser guide is normally vacuum assisted so that the sheet is held against the guide and hence, properly oriented as the sheet enters the fuser section. This type of curved travel path and guide is known and have been commercially used, e.g. DIGIMASTER 9110, Heidelberg Digital L.L.C., Rochester, N.Y.

As a sheet moves along this type of extended travel path, it is particularly important to prevent the sheet from falling away from the fuser entrance guide as the trail edge of the sheet moves across the guide and into the fuser section. If the sheet should drop, it may contact and slide across other elements in the paper path before it enters the fuser section. If this happens, it is likely that smearing of the unfused image on the sheet will occur.

Ideally, the vacuum being applied at the guide will be strong enough to hold the sheet in contact with the guide's surface until the sheet has completely entered the fuser. While providing such a strong vacuum would normally present no problem, it must be recognized that this vacuum can not be too strong or it will cause the sheet to slow down significantly or to stall completely on the guide's surface thereby resulting in serious jamming problems or the like. Therefore, it is important to maintain the vacuum force at the guide so that it will hold a sheet in contact with guide surface as the sheet moves across the guide but, at the same time, will allow the vacuum transport to readily move the sheet across the guide and into the fuser.

Unfortunately, however, in machines of this type, there are other factors, which affect the sheet as it moves along the paper travel path within the machine. For example, as the sheet passes across the gap between the exit of the vacuum transport and the entrance of the fuser guide, the sheet is routinely subjected to unwanted air currents within the machine. These air currents are those which are inherently generated by the common air movers (e.g. cooling fans, etc.) within the machine which are necessary for regulating the internal machine temperature, removing contamination, etc.

During operation, these air currents blow onto the sheet as it passes through the gap between the vacuum transport and the fuser guide and act in opposition to the vacuum being applied at the guide. That is, the air currents blow against the sheet and try to force it away from the surface of the guide while the vacuum tries to hold the sheet against this surface. If one merely provides a stronger vacuum to compensate for these air currents, the resulting vacuum is likely to be so strong that it will cause the sheet to slow or stall as the sheet moves across the guide, which is unacceptable. Further, a larger air mover would be required to produce the necessary vacuum.

Accordingly, it is highly desirable to protect the sheet from these air currents as the sheets moves along the paper travel path and into the fuser section of the machine so that the vacuum can be maintained within a range strong enough to hold the sheet against the guide but not so strong as to slow or stall the sheet at the guide.

SUMMARY OF THE INVENTION

The present invention provides a means and a method for increasing the efficiency of a vacuum-assisted, fuser entrance guide in an electrophotographic apparatus by deflecting unwanted air currents, inherently present within the apparatus, away from the sheet of copy medium as the sheet moves across the gap which exist between the terminal end of the vacuum transport and the fuser entrance guide which guides the sheet into the fuser section of the apparatus.

Basically, in accordance with the present invention, a baffle or seal, which has a deflecting surface, is positioned within the gap between the vacuum transport and the fuser guide. The deflecting surface of the baffle extends substantially across the gap and blocks a significant portion of the unwanted air currents that inherently flow into the gap during operation of the apparatus. These air currents are deflected away from the sheet as the sheet moves across the gap.

More specifically, the present invention provides an electrophotographic apparatus for copying an image onto a sheet of a copy medium (e.g. paper) wherein the apparatus is basically comprised of a continuous loop of film for transferring the image to the sheet, a fuser section, and a travel path for transporting the sheet from the film to the fuser section. The travel path is comprised of a vacuum transport, which receives the sheet from the film and moves it towards the fuser, and a vacuum-assisted, fuser entrance guide for receiving the sheet from the vacuum transport and guiding it into the fuser section. The fuser guide is spaced from the vacuum transport whereby a gap is formed therebetween.

A deflector means (e.g. baffle) is positioned within this gap to effectively close the gap and deflect the air currents, which inherently flow into the gap during the copying operation, away from the sheet as the sheet moves from the vacuum transport onto the surface of the fuser guide. Thus, the deflector means prevents the force of these unwanted air currents from counteracting the vacuum forces on the sheet as it moves across the surface of the guide and into the fuser section. That is, if unabated, these air currents would act directly against the sheet and tend to push the sheet off of the guide surface as the sheet moved across the gap. If the vacuum being applied by the guide is not strong enough, the force of the air current could cause the sheet to sag downward off the guide's surface thereby resulting in possible smearing of the unfused image on the sheet.

Also, by shielding the gap from these unwanted air currents, the vacuum transport fans (i.e. air movers) present in the apparatus will now evacuate air from the substantially closed gap thereby creating a substantial static pressure drop (i.e. vacuum) in the gap area. This vacuum, now inherently present in the gap, will act to hold the sheet upward as it moves across the gap and onto the guide's surface thereby alleviating the possibility that a portion of the sheet (i.e. trail end) may sag as it moves across the gap.

Accordingly, by blocking the unwanted air currents and inherently producing a vacuum within the gap, the present invention allows a smaller vacuum to be used for holding the sheet against the fuser guide and into the fuser section. By using a smaller vacuum, there are less drag forces on the moving sheet thereby reducing the possibility that the sheet may stall on the guide. Also, the smaller vacuum requires smaller air movers, which, in turn, reduces the overall cost of the apparatus.

BRIEF DESCRIPTION OF THE DRAWINGS

The actual construction operation, and apparent advantages of the present invention will be better understood by referring to the drawings, not necessarily to scale, in which like numerals identify like parts and in which.

While the invention will be described in connection with its preferred embodiments, it will be understood that this invention is not limited thereto. On the contrary, the invention is intended to cover all alternatives, modifications, and equivalents which may be included within the spirit and scope of the invention, as defined by the appended claims.

DESCRIPTION OF THE PREFERRED EMBODIMENTS

Figure 1:
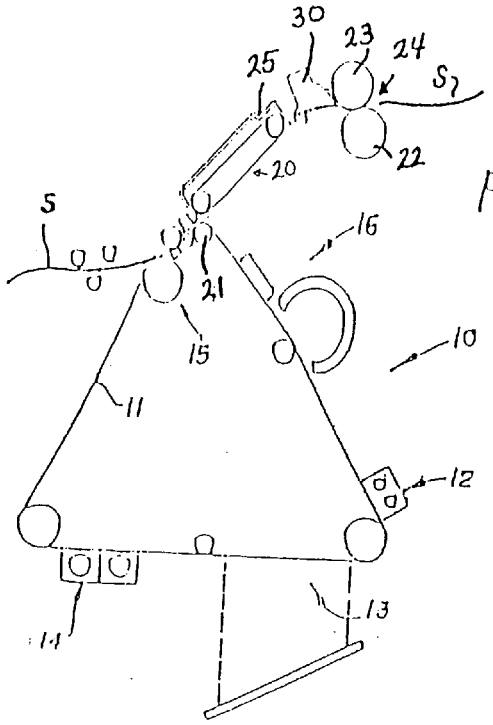
FIG. 1 is a schematic view of an electrophotographic apparatus (e.g. copier/printer machine) in which the present invention is incorporated.

FIG. 1 illustrates a typical electrophotographic apparatus or machine 10 (e.g. copier, duplicator, printer) in which the present invention can be incorporated. Machine 10 is of the type that uses an endless photoconductor member 11 (e.g. photographic film) to transfer a copy of an inputted image onto a sheet S of a copy medium. The film moves through a closed loop past a charging section 12, an exposure or input section 13, a developing section 14, an image transfer section 15, and an erase/clean section 16. Sheet S of a copy medium (e.g. paper) is fed from a supply (not shown) through image transfer section 15 where the toner image on the film 11 is transferred to the sheet S. Sheet S is then fed along a travel path 20 from a detack roller 21 in the image transfer section 15 to a fuser section 24 where the sheet S passes through the "nip" between a fusing roller 22 and a pressure roller 23 to thereby "fuse" the toner image onto sheet S before the sheet exits the machine.

Figure 2:
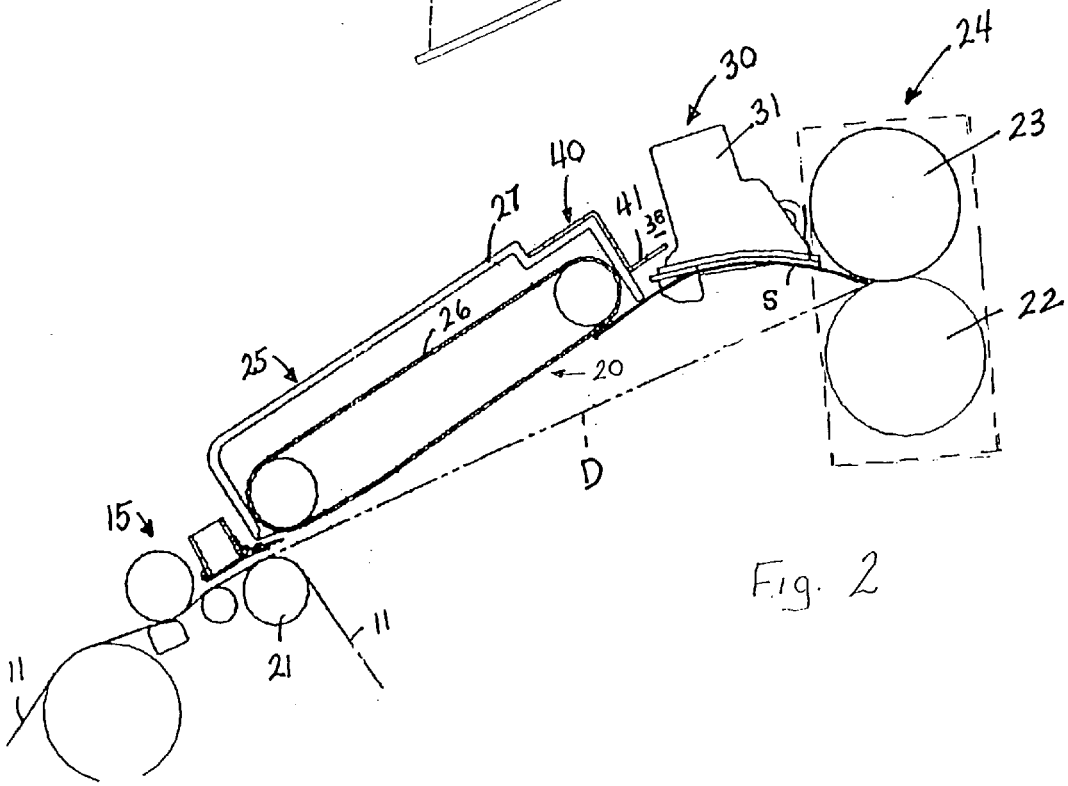
FIG. 2 is an enlarged, sectional view of the paper travel path of the apparatus of FIG. 1 having the present invention incorporated therein.

FIG. 2 is an enlarged, cross-sectional view of the travel path 20 of FIG. 1 and is comprised of a vacuum transport 25 and a fuser entrance guide 30, the latter being positioned between the exit end of vacuum transport 25 and the entrance of fuser section 24. The vacuum transport 25 is of the type well known in the art and basically is comprised of an endless, perforated belt(s) 26 which moves over a stationary, perforated plate (not shown) within a housing 27. As will be understood in the art, a pressurized stream of air (not shown) is flowed through housing 27 to create a vacuum. This vacuum acts through cooperating openings (not shown) in the plate/belt to hold the sheet against the belt as the belt moves the sheet towards the fuser section 24.

As seen in FIG. 2, travel path 20 is "curved" in that vacuum transport 25 is angled with respect to D (i.e. the straight-line distance between detack roller 21 and fuser section 24) and the lower surface of guide 30 is curved. By making the travel path 20 longer than D, guide 30 provides a "buffer" zone which effectively "de-couples" the speed of the detack roller 21 from the speed of fuser rollers 22, 23.

This allows the trail edge of sheet S (even the longest sheet used) to be completely clear of detack roller 21 before the leading edge of the sheet is delivered to the nip between the fuser rollers 22, 23. This prevents any relative movement between the film 11 and sheet S when the sheet and the film are in contact with each other, thereby eliminating possible smearing as the toner image is being transferred onto sheet S.

However, since there is still a possibility that some smearing may occur if the unfused image on sheet S comes into contact with other elements in the travel path before the trail edge of sheet S has completely entered the fuser section 24, the base plate 35 of guide 30 is provided with vacuum ports (not shown). Air is passed through guide housing 31 to create a vacuum through the ports in the base plate 35 to hold the sheet S against the base plate as the vacuum transport 25 moves sheet S towards the fuser section 24.

The number and placement of vacuum ports in base plate 35 are designed so that the holding force of the vacuum (i.e. force necessary to hold the sheet on the base plate) is balanced against the drag forces produced by the vacuum on the moving sheet. That is, the vacuum applied against the sheet has to be strong enough to hold the sheet in contact with the guide but cannot be so strong as to stall or seriously impede the vacuum transport's 25 ability to move sheet S across guide 30 and into fuser 24. For a more complete description of such a travel path and fuser entrance guide 30, see co-pending and commonly assigned U.S. Pat. application, Ser. No. 10/667,558, filed Sep. 22, 2003, which is incorporated by reference herein in its entirety.

As will be fully understood in the art, machines 10 of the type described above, always include one or more common air movers (e.g. fans, etc., not shown) which are necessary to control internal temperatures, remove contamination (paper dust, etc.), etc. Unfortunately, these air movers, in addition to producing the necessary air flows, also produce ancillary air currents, which can be detrimental in the operation of the machine.

Figure 3:
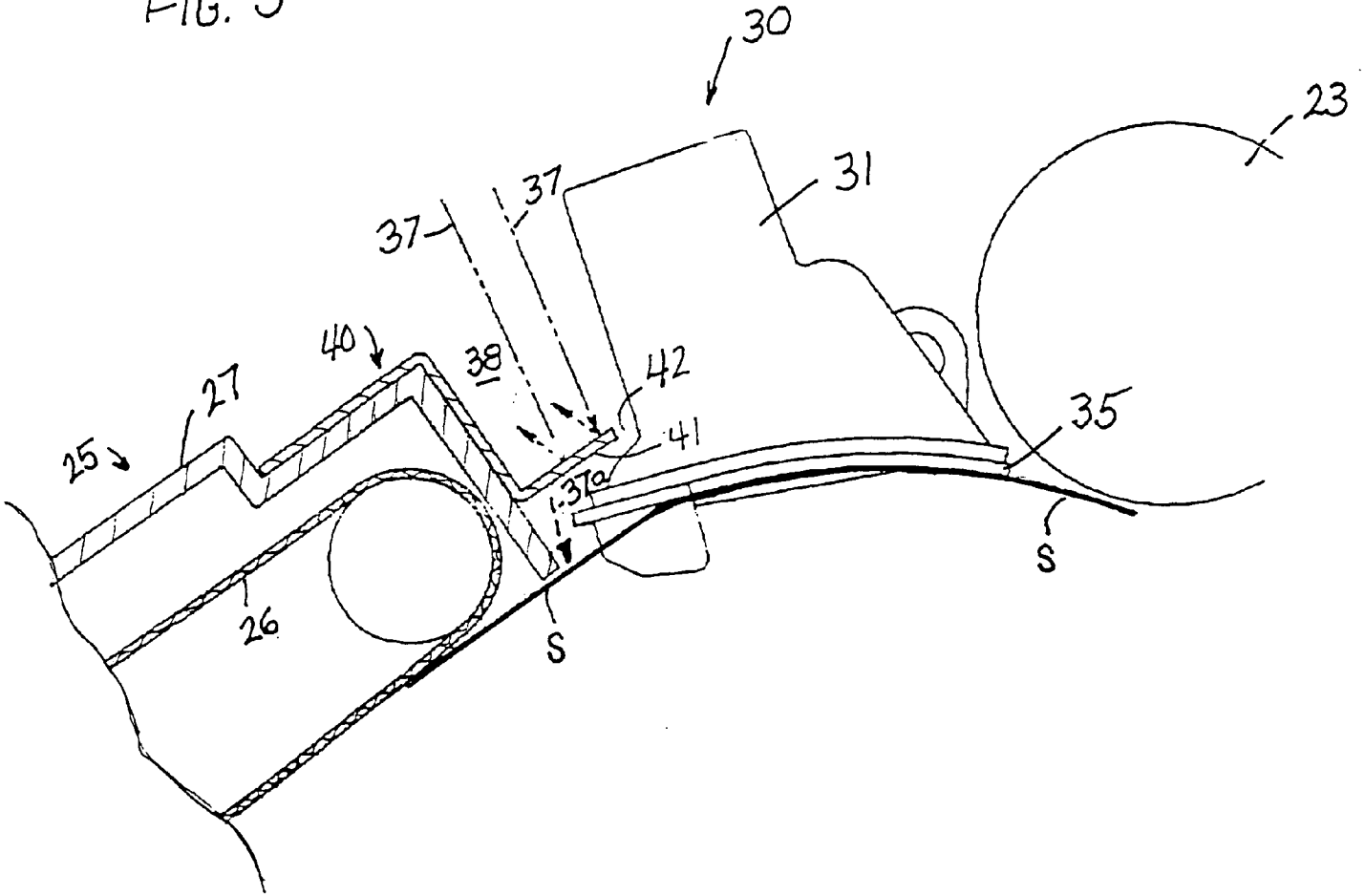
FIG. 3 is a still further enlarged sectional view of a portion of the travel path of FIG. 2, better illustrating the air baffle of the present invention.

That is, as best seen in FIG. 3, it has been found that normal operation of the common air movers (not shown) in machine 10 produce detrimental and unwanted air currents 37, some of which, due to the design of machine 10, will be directed downward (as viewed in FIG. 3) into the gap 38 which exists between the exit end of vacuum transport 25 and the entrance into fuser guide 30. If ignored, these air currents will impact onto sheet S (e.g. dotted line 37*a*) as the sheet passes through gap 38 thereby applying a downward force on the sheet S. This downward force is opposite to the vacuum force on sheet S being applied to sheet S through base plate 35 of guide 30. If the downward forces exceed the vacuum force, sheet S can be pushed off the guide surface whereupon it can contact other elements in the machine which, in turn, can smear the unfused image on sheet S.

One solution would be to merely increase the vacuum at guide 30 but, as discussed above, a stronger vacuum force on sheet S can produce drag forces on the sheet, which can substantially slow or even stall movement of sheet S as it moves across guide 30. This, of course is totally unacceptable for sustained operations. Further, a larger air mover would be required to significantly increase the vacuum thereby substantially increasing the costs of the machine.

In solving this problem in accordance with the present invention, a deflector means, e.g. baffle 40, is positioned within gap 38 which diverts and deflects air currents 37 away from sheet S as shown in FIG. 3. Baffle 40 may be comprised of any appropriate material, e.g. aluminum, plastic, other metals, metal alloys, etc.). As illustrated in FIGS. 1–3, baffle is fixed to housing 27 of vacuum transport 25 by any appropriate means (e.g. welding, adhesive, threaded fasteners, etc.), depending on the materials involved. Baffle 40 has a deflecting surface 41, which has the proper dimensions, both length and width, whereby it extends across gap 38 for a distance sufficient to effectively block air currents 37. Of course, baffle 40 can have a different configuration from that shown whereby it can be attached to housing 31 of guide 30 instead of housing 27 as long as deflector surface 41 extends substantially across gap 38.

By providing baffle 40 across gap 38, substantially all of the unwanted air currents will be blocked and deflected away from sheet S and will not impact thereon. Accordingly, since the downward force of currents 37 are effectively canceled by baffle 40, there is no need to increase the vacuum force being applied through base plate 35 of guide 30 to hold sheet S against guide 30. In addition to increasing the efficiency of guide 30, baffle 40 allows a smaller air mover to be used to create the necessary vacuum within guide 30 thereby reducing the overall costs of machine 10.

Also, it has been found that by substantially blocking gap 38, the air movers (not shown) present in the vacuum transport 25 will now evacuate air from the closed gap area which, in turn, creates a significant static pressure drop (i.e. vacuum) in the gap area. This added vacuum aids in maintaining sheet S in its desired path and from sagging as it passes across gap 38 and onto the surface of the guide 30.

The size of the opening 42 (FIG. 3) determines the vacuum force that is created within gap 38. That is, the vacuum is increased as opening 42 becomes smaller and is decreased as opening 42 becomes larger. Since the characteristics (e.g. size, weight, etc.) of the particular sheets may vary significantly for different copy operations, it may be desirable to adjust the size of opening 42 rather than have it fixed (as shown in FIGS. 1–3) in order to vary the vacuum pressure within the gap 38 as needed.

Figure 4:
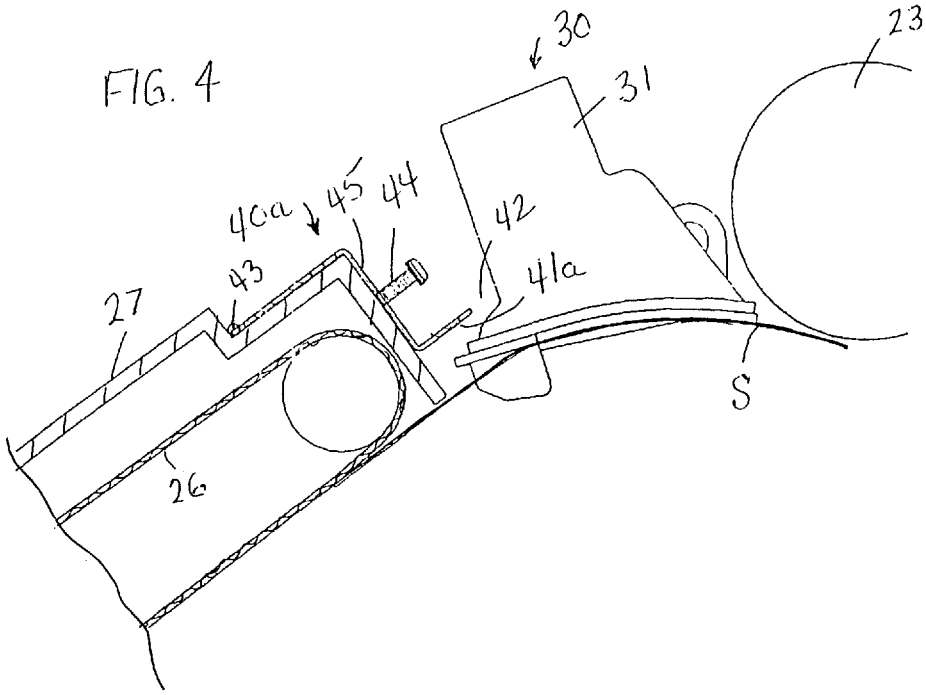
FIG. 4 is an enlarged, sectional view of a further embodiment of the present invention when in a first position.
Figure 5:
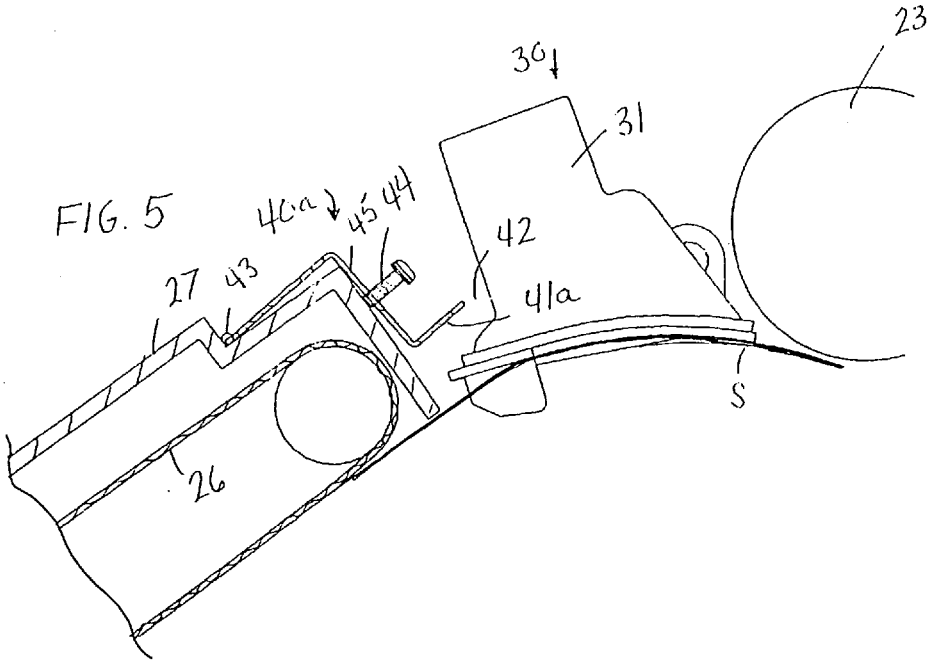
FIG. 5 is a view, similar to FIG. 4, showing the embodiment when in a second position.

Referring now to FIGS. 4 and 5, an embodiment of the present invention is shown wherein the opening 42 is adjustable to provide different vacuum pressures within gap 38. Deflection means 40*a* is pivotably mounted on vacuum transport housing 27 at pivot 43 and can rotate from a first position (FIG. 4) to any one of several different positions, e.g. that shown in FIG. 5, to thereby adjust the size of opening 42 between the deflecting surface 41*a* and the guide housing 31. An adjustable detent 44 is provided to adjust deflection means 40 to a predetermined position and maintain it there once set.

As shown, detent 44 is comprised of a thumbscrew or the like that is threaded through the wall 45 of means 40*a*. As seen in FIG. 5, the inner end of screw 44 will abut housing 27 as screw 44 is threaded into wall 45. As the screw is threaded inwardly, the deflector means 40*a* will rotate (i.e. raise) about pivot 43 thereby adjusting the size of opening 42. The inner end of screw 44, resting on housing 27, will maintain the means 40*a* in a desired, predetermined position until it is readjusted to provide a different size for opening 42.

The deflector means of the present invention provides a "loose seal" within the gap 38 and is designed so that the attractive forces exerted by the vacuum created across opening 42 does not exceed the drive capabilities of the vacuum transport 25. Further, the deflector means increases the effective holding force of both the vacuum transport and fuser entrance guide without requiring larger air movers. Still further, it is a more efficient application of vacuum as the continuity of the vacuum is maintained throughout the travel path of the sheet into the fuser. This is important since if the vacuum continuity were interrupted, higher attractive forces (vacuum) that were originally present would be required to re-acquire the sheet.

What is claimed is:

1. An electrophotographic apparatus for copying an image onto a sheet of a copy medium, said apparatus having a continuous loop of film for transferring said image to said sheet, a fuser section, and a travel path for transporting said sheet from said film to said fuser section, said travel path comprising:

a vacuum transport for receiving said sheet from said film and moving said sheet towards said fuser;

a fuser entrance guide for receiving said sheet from said vacuum transport and guiding said sheet into said fuser section, said fuser guide being spaced from said vacuum transport whereby a gap is formed therebetween; and a deflector positioned within said gap to block and deflect air currents flowing into said gap away from said sheet as said sheet moves across said gap.

2. The electrophotographic apparatus of claim 1 wherein said vacuum transport includes a housing and wherein said deflector comprises a baffle attached to said vacuum transport housing.

3. The electrophotographic apparatus of claim 2 wherein said baffle includes a deflecting surface, which extends substantially across said gap.

4. The electrophotographic apparatus of claim 1 wherein said vacuum transport includes a housing and wherein said deflector comprises a baffle pivotably attached to said vacuum transport housing.

5. The electrophotographic apparatus of claim 4 including:

an adjustable detent on said deflector for maintaining said deflector in a predetermined position.

6. The electrophotographic apparatus of claim 5 wherein said detent comprises:

a screw threaded through said deflector and adapted to engage said vacuum transport housing.

7. The electrophotographic apparatus of claim 6 wherein said fuser guide has a housing and wherein said deflector comprises a baffle attached to said fuser guide housing.

8. A travel path in an electrophotographic apparatus for transporting a sheet of a copy medium to said fuser section, said travel path comprising:

a vacuum transport for moving said sheet towards said fuser;

a fuser entrance guide for receiving said sheet from said vacuum transport and guiding said sheet into said fuser section, said fuser guide being spaced from said vacuum transport whereby a gap is formed therebetween; and a deflector positioned within said gap to block and deflect air currents flowing into said gap away from said sheet as said sheet moves across said gap.

9. The travel path of claim 8 wherein said vacuum transport includes a housing and wherein said deflector comprises a baffle attached to said vacuum transport housing.

10. The travel path of claim 9 wherein said baffle includes a deflecting surface, which extends substantially across said gap.

11. The travel path of claim 8 wherein said vacuum transport includes a housing and wherein said deflector comprises a baffle pivotably mounted on said vacuum transport housing.

12. The travel path of claim 11 including:

an adjustable detent on said deflector for maintaining said deflector in a predetermined position.

13. The travel path of claim 12 wherein said detent comprises:

a screw threaded through said deflector and adapted to engage said vacuum transport housing.

14. The travel path of claim 8 wherein said fuser guide has a housing and wherein said deflector comprises a baffle attached to said fuser guide housing.

15. In an electrophotographic apparatus having a travel path for transporting a sheet of copy medium to a fuser section wherein said travel path includes a vacuum transport and a vacuum-assisted, fuser entrance guide spaced therefrom forming a gap therebetween, a method of increasing the efficiency of said fuser guide, said method comprising:

blocking and deflecting air currents flowing through said gap away from said sheet as said sheet moves across said gap with a deflector attached to said electrophotographic apparatus.

16. The method of claim 15 wherein said air currents are deflected by positioning a baffle within said gap.

* * * * *